US007313348B2

(12) United States Patent
Hart et al.

(10) Patent No.: US 7,313,348 B2
(45) Date of Patent: Dec. 25, 2007

(54) XEROGRAPHIC DEVELOPER UNIT HAVING VARIABLE PITCH AUGER

(75) Inventors: Steven C. Hart, Webster, NY (US); Ajay Kumar, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 137 days.

(21) Appl. No.: 11/263,369

(22) Filed: Oct. 31, 2005

(65) Prior Publication Data

US 2007/0098450 A1 May 3, 2007

(51) Int. Cl.
*G03G 15/08* (2006.01)

(52) U.S. Cl. ..... 399/256; 399/254

(58) Field of Classification Search ..... 399/254, 399/256, 267, 269, 272, 279, 281
See application file for complete search history.

(56) References Cited

U.S. PATENT DOCUMENTS 5,204,721 A * 4/1993 Sharpe ..... 399/256
5,583,622 A * 12/1996 Nishimura ..... 399/256 X
5,923,933 A * 7/1999 Anzai et al. ..... 399/269
6,324,369 B1 * 11/2001 Yamaguchi et al. ..... 399/254
6,415,125 B1 * 7/2002 Yamamoto et al. ..... 399/254
6,421,516 B1 * 7/2002 Kinoshita et al. ..... 399/254
6,546,225 B2 4/2003 Wang
6,763,214 B2 * 7/2004 Sugihara ..... 399/254
6,973,281 B2 * 12/2005 Hirobe et al. ..... 399/269

* cited by examiner

*Primary Examiner*—Sandra L. Brase
(74) *Attorney, Agent, or Firm*—Lloyd F. Bean, II

(57) ABSTRACT

A developer system, including: a developer housing having a sump containing developer material including toner particles; a developer member rotatably mounted in the housing for transferring toner particles to a latent image on the photoreceptive member in a development zone; a pickup auger, positioned in an auger channel, for transporting and delivering developer material to the developer member, along a path adjacent to the developer member, the pickup auger having a first end portion and a second end portion, and the pickup auger includes a plurality of blades extending along the length of thereof, the plurality of blades being mounted on a core having a core size, the core size being adapted and arranged in the auger channel to maintain a constant developer material distance from the developer member along the length the auger channel.

18 Claims, 8 Drawing Sheets

XEROGRAPHIC DEVELOPER UNIT HAVING VARIABLE PITCH AUGER

CROSS-REFERENCE TO RELATED APPLICATIONS

Reference is made to commonly-assigned copending U.S. patent application Ser. No. 11/263,371, filed concurrently herewith, now U.S. Publication No. 2007/0098448, entitled DEVELOPER HOUSING DESIGN WITH IMPROVED SUMP MASS VARIATION LATITUDE, by Steven C. Hart and Ajay Kamar; copending U.S. patent application Ser. No. 11/263,370, filed concurrently herewith, now U.S. Publication No. 2007/0098451, entitled XEROGRAPHIC DEVELOPER UNIT HAVING VARIABLE PITCH AUGER, by Steven C. Hart and Ajay Kamar; copending U.S. patent application Ser. No. 11/262,577, filed concurrently herewith, now U.S. Publication No. 2007/0098458, entitled XEROGRAPHIC DEVELOPER UNIT HAVING MULTIPLE MAGNETIC BRUSH ROLLS WITH A GROOVED SURFACE, by Ajay Kumar, Keith A. Nau, David A. Reed, Jonathan D. Sadik, and Cory J. Winters; copending U.S. patent application Ser. No. 11/262,575, filed concurrently herewith, now U.S. Publication No. 2007/0098456, entitled XEROGRAPHIC DEVELOPER UNIT HAVING MULTIPLE MAGNETIC BRUSH ROLLS ROTATING AGAINST THE PHOTORECEPTOR, by Michael D. Thompson, James M. Chappell, Steven C. Hart, Patrick J. Howe, Ajay Kumar, Steven R. Leroy, Paul W. Morehouse, Jr., Palghat S. Ramesh, and Fei Xiao; and copending U.S. patent application Ser. No. 11/262,576, filed concurrently herewith, now U.S. Publication No. 2007/0098457, entitled XEROGRAPHIC DEVELOPER UNIT HAVING MULTIPLE MAGNETIC BRUSH ROLLS ROTATING WITH THE PHOTORECEPTOR, by James M. Chappell, Patrick J. Howe, Michael D. Thompson, and Fei Xiao, the disclosures of which are incorporated herein.

BACKGROUND

This invention relates generally to the development of electrostatic images, and more particularly concerns a two component development apparatus having a variable pitch auger to improve pickup latitude in developer housing.

Generally, the process of electrophotographic printing includes sensitizing a photoconductive surface by charging it to a substantially uniform potential. The charge is selectively dissipated in accordance with a pattern of activating radiation corresponding to a desired image. The selective dissipation of the charge leaves a latent charge pattern that is developed by bringing a developer material into contact therewith. This process forms a toner powder image on the photoconductive surface which is subsequently transferred to a copy sheet. Finally, the powder image is heated to permanently affix it to the copy sheet in image configuration.

Two component and single component developer materials are commonly used. A typical two component developer material comprises magnetic carrier granules having toner particles adhering triboelectrically thereto. A single component developer material typically comprises toner particles having an electrostatic charge so that they will be attracted to, and adhere to, the latent image on the photoconductive surface.

There are various known development systems for bringing toner particles to a latent image on a photoconductive surface. These are: single component, two component, and hybrid systems. Additionally the single component and hybrid systems may be either scavenging or scavengeless; two component development systems are almost always scavenging. The term scavenging or scavengeless denotes whether the development method would disturb any previously developed image already on the photoconductive surface. if any previously developed image is left undisturbed, the system is scavengeless.

Single Component Development Systems: A (scavenging) single component development system uses a donor roll for transporting charged toner to the development nip defined by the donor roll and the photoconductive surface. The toner is loaded onto the donor roll by direct contact with a toner reservoir and sometimes with the assistance of a toner loading brush or foam roll. The donor roll rotates to bring the charged toner into the development nip. Using a combination of AC and /or DC electrical biases, the toner is moved from the donor roll to the photoconductive surface. Thus, the toner is developed on the latent image recorded on the photoconductive surface.

A scavengeless single component development system is physically similar to a scavenging single component system except that it uses a donor roll with a plurality of electrode wires closely spaced therefrom in the development zone. An AC voltage is applied to the wires detaching the toner from the donor roll and forming a toner powder cloud in the development zone. The electrostatic fields generated by the latent image attract toner from the toner cloud to develop the latent image.

Two Component Development Systems: in a two component development system, a magnetic developer roll (with rotating external shell and an interior magnetic assembly which can be either stationary or rotating) attracts developer from a reservoir. The developer includes carrier and toner. As the external shell rotates and transports the developer material, the developer material is subsequently trimmed or metered to a desired uniform thickness. This layer of material is commonly referred to as a magnetic brush. Further rotation of the external shell advances the developer material into the development nip. In the development nip, the magnetic brush is brought into contact with the photoreceptor. Here, the toner is attracted from the carrier beads to the photoreceptor to develop the latent image. Further rotation of the developer roll returns the carrier beads and unused toner to the developer housing reservoir or sump.

Hybrid Development Systems: A hybrid development system is a cross between a single component development system and a two component system. A Hybrid system uses two component developer materials in conjunction with a magnetic developer roll to form a magnetic brush. However instead of developing the image directly with the magnetic brush, the magnetic brush is used to apply a uniform layer of toner onto a donor roll. Then as the donor roll rotates, the toner layer is advanced into the development nip and the latent image is developed in a manner similar to single component systems. A Hybrid System may be either scavenging or scavengeless.

Two component systems, either strictly two component or hybrid, require a uniform layer of developer material on the developer roll to function optimally. This layer of material must be provided independent of many factors. In some developer housing designs, developer material is picked up from one auger, trimmed to the desired thickness, used to develop an image or to load a donor roll, and then released into different auger. This results in a gradient in the developer material mass (or volume fill) down the length of the pick up auger region; one end of the auger is nearly full and the other end would be almost empty. One solution known in the prior art to deal with this variation, is to vary the "pick up" magnetic pole strength along the developer roll with a weaker pick up pole strength being used to acquire material in the almost full end of the auger and a very strong magnetic pole strength being used to acquire material from the almost empty end of the auger. An undesirable feature of this approach is that it is difficult to manufacture a magnetic structure with the appropriately varying magnetic strength.

A second solution known in the prior art is to simply use a uniform and very strong pickup magnet. An undesirable outcome of this solution is that much more material than necessary would be picked up from the nearly full end of the donor roll. This causes a small non-uniformity in the layer thickness, increases mechanical power requirements needed to rotate the donor roll, increases developer material abuse, and leads to a higher unit manufacturing cost (UMC).

SUMMARY

There is provided an "upper transport auger" or "pick up auger" with a variable pitch. The optimum pitch variation is linear down the length of the auger. A variable pitch auger can maintain a constant volumetric filling when used in a developer housing where developer material is picked up from one auger, used to develop an image, and then released into different auger. The significance of this is that the distance between the developer material available for "pick up" and the developer roll is kept constant down the length of the roll and auger. Maintaining the "pick up" material supply at a constant (and close) distance from the pickup region of the developer roll. This eliminates the need to overachieve the "pick up" function at one end, or alternatively to manufacture a magnet assembly with a uniformly varying magnetic pick up field strength. This enables the use of lower strength "pick up" magnetic fields and at the same time presents a uniform amount of material to the trim region independent of position down the length of the roll. The lower strength pick up magnetics reduces the mechanical power required to drive the housing, enhances developer roll shell life, and reduces developer material abuse. The uniform amount of material presented to the trim region also improves the MOR uniformity.

There is also provided a developer system, comprising: a developer housing having a sump containing developer material including toner particles; a developer member rotatably mounted in said housing for transferring toner particles to a latent image on said photoreceptive member in a development zone; a pickup auger, positioned in an auger channel, for transporting and delivering developer material to said developer member, along a path adjacent to said developer member, said pickup auger having a first end portion and a second end portion, and said pickup auger includes a plurality of blades extending along the length of thereof, said plurality of blades being mounted on a core having a core size, said core size being adapted and arranged in said auger channel to maintain a constant developer material distance from said developer member along the length said auger channel.

DETAILED DESCRIPTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Figure 1:
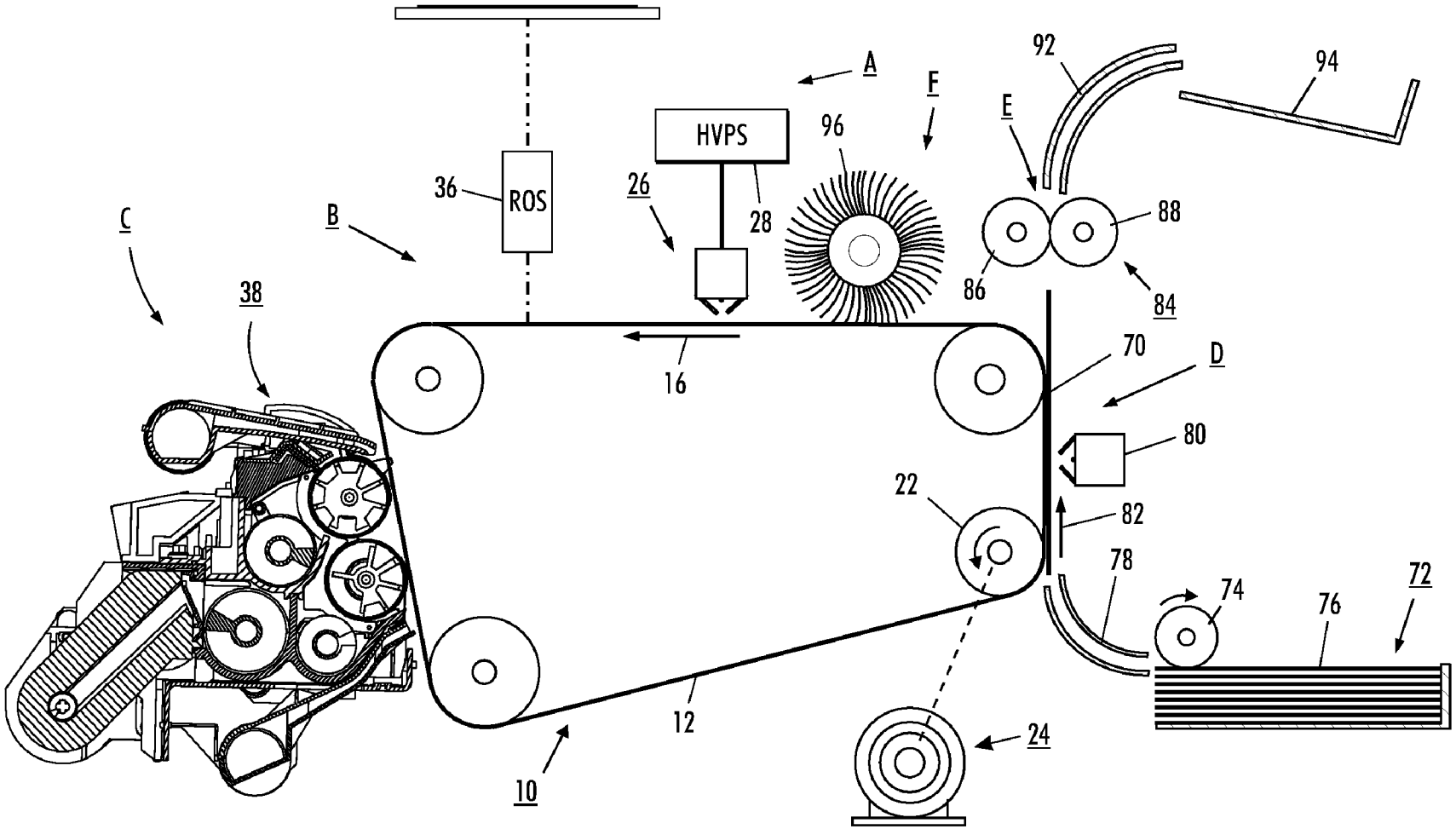
FIG. 1 is a schematic elevational view of an illustrative electrophotographic printing machine incorporating developer unit having the features of the present invention therein.

Referring initially to FIG. 1, there is shown an illustrative electrophotographic printing machine incorporating the development apparatus of the present invention therein. The electrophotographic printing machine employs a belt 10 having a photoconductive surface 12 deposited on a conductive substrate. Belt 10 moves in the direction of arrow 16 to advance successive portions of photoconductive surface 12 sequentially through the various processing stations disposed of throughout the path of movement thereof. Motor 24 rotates belt 10 in the direction of arrow 16. Roller 22 is coupled to motor 24 by suitable means, such as a drive belt.

Initially, a portion of belt 10 passes through charging station A. At charging station A, a corona generating device, indicated generally by the reference numeral 26 charges photoconductive surface 12 to a relatively high, substantially uniform potential. High voltage power supply 28 is coupled to corona generating device 26 to charge photoconductive surface 12 of belt 10. After photoconductive surface 12 of belt 10 is charged, the charged portion thereof is advanced through exposure station B.

At exposure station B, a controller receives the image signals from Print Controller representing the desired output image and processes these signals to convert them to signals transmitted to a laser based output scanning device, which causes the charge retentive surface to be discharged in accordance with the output from the scanning device. Preferably the scanning device is a laser Raster Output Scanner (ROS) 36. Alternatively, the ROS 36 could be replaced by other xerographic exposure devices such as LED arrays.

After the electrostatic latent image has been recorded on photoconductive surface 12, belt 10 advances the latent image to development station C. At development station C, a developer unit, indicated generally by the reference numeral 38, develops the latent image recorded on the photoconductive surface. Developer rolls 40 and 41 are mounted, at least partially, in the chamber of the developer housing. The chamber in the developer housing stores a supply of developer material. In one embodiment the developer material is a single component development material of toner particles, whereas in another, the developer material includes at least toner and carrier.

With continued reference to FIG. 1, after the electrostatic latent image is developed, belt 10 advances the toner powder image to transfer station D. A copy sheet 70 is advanced to transfer station D by sheet feeding apparatus 72. Preferably, sheet feeding apparatus 72 includes a feed roll 74 contacting the uppermost sheet of stack 76 into chute 78. Chute 78 directs the advancing sheet of support material into contact with photoconductive surface 12 of belt 10 in a timed sequence so that the toner powder image developed thereon contacts the advancing sheet at transfer station D. Transfer station D includes a corona generating device 80 which sprays ions onto the back side of sheet 70. This attracts the toner powder image from photoconductive surface 12 to sheet 70. After transfer, sheet 70 continues to move in the direction of arrow 82 onto a conveyor (not shown) that advances sheet 70 to fusing station E.

Fusing station E includes a fuser assembly, indicated generally by the reference numeral 84, which permanently affixes the transferred powder image to sheet 70. Fuser assembly 84 includes a heated fuser roller 86 and a back-up roller 88. Sheet 70 passes between fuser roller 86 and back-up roller 88 with the toner powder image contacting fuser roller 86. In this manner, the toner powder image is permanently affixed to sheet 70. After fusing, sheet 70 advances through chute 92 to catch tray 94 for subsequent removal from the printing machine by the operator.

After the copy sheet is separated from photoconductive surface 12 of belt 10, the residual toner particles adhering to photoconductive surface 12 are removed therefrom at cleaning station F. Cleaning station F includes a rotatably mounted fibrous brush 96 in contact with photoconductive surface 12. The particles are cleaned from photoconductive surface 12 by the rotation of brush 96 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present disclosure therein.

Figure 2:
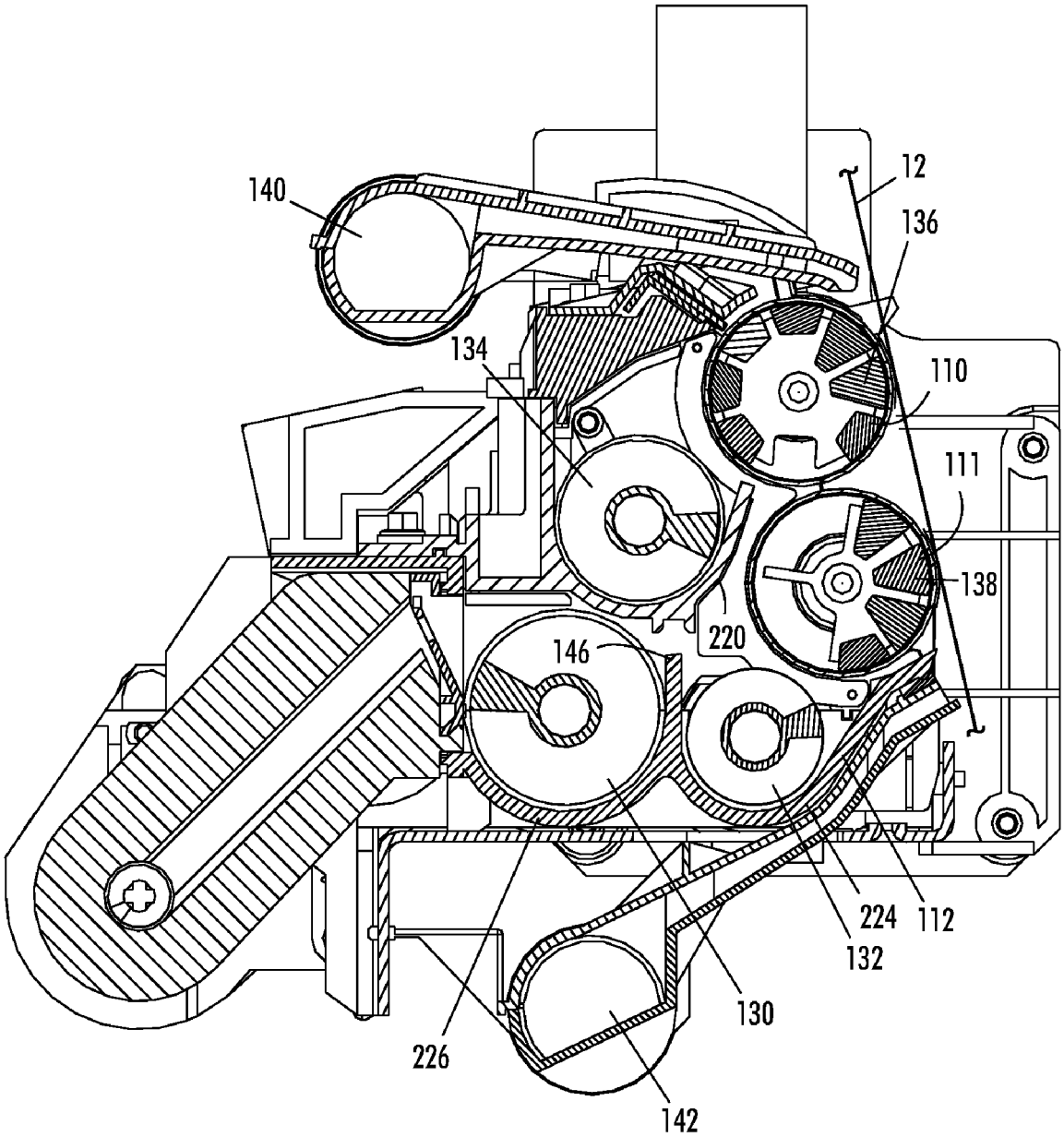
FIG. 2 is a schematic elevational view showing one embodiment of the developer unit used in the FIG. 1 printing machine.

Referring now to FIG. 2, there is shown an embodiment of the present disclosure in greater detail. The overall function of developer unit 100 is to apply marking material, such as toner, onto suitably-charged areas forming a latent image on an image receptor such as belt 10 (a portion of which is shown), in a manner generally known in the art. In various types of printers, there may be multiple such developer units, such as one for each primary color or other purpose.

Figure 3:
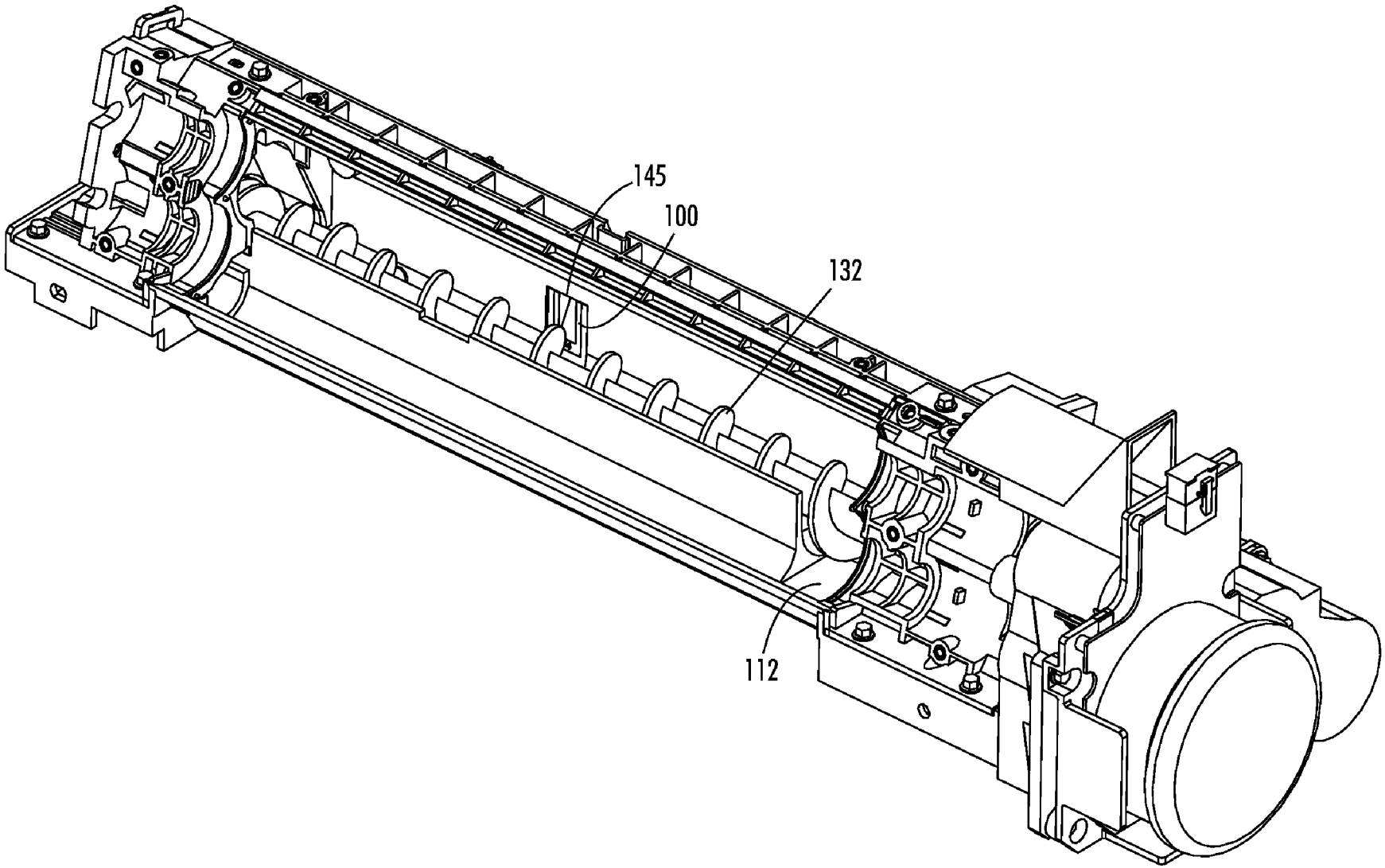
FIG. 3 is an illustration of the portion of the developer unit of the present disclosure

Among the elements of a the developer unit shown in FIGS. 2 and 3, which are typical of developer units of various types, are a housing 112, which functions generally to hold a supply of developer material, as well as augers such as 130,132, 134, which variously mix and convey the developer material, and magnetic development rolls 136, 138, which in this embodiment form magnetic brushes to apply developer material to the belt 10.

For the illustrated embodiment wherein the magnetic development rolls 136, 138, are a relatively rigid cylinder, disposed within each magnetic development rolls 136, 138 there is a stationary "magnetic structure" 110, 111. The magnetic structure 110, 111 is designed to remain in one position while the magnetic development roll rotates around it. The magnetic structure 110, 111 includes any number of magnetic members as necessary, and these magnetic members may be in the form of discrete metal magnets, or areas of specific magnetic polarity within a continuous structure, such as in a "plastic magnet." Conceivably, the magnetic structure 110, 111 may comprise electromagnets as well. The purpose of the magnetic structures 110, 111 within magnetic development rolls 136, 138 is to attract the magnetic carrier from the developer supply and cause the magnetic carrier to magnetically adhere to the surface of the magnetic development roll as a given portion of the surface of magnetic development roll is advanced, with motion of magnetic development roll, towards the development zone. As is well-known in the art of xerography, two-component developer generally functions as follows: the carrier particles, or beads, attracted by the magnets within magnetic structure 110, 111, form filaments of a "magnetic brush", particularly around the poles defined in the magnetic structure, much in the manner of iron filings. Adhering triboelectrically to the carrier beads is any number of toner particles. The magnetic brush of carrier beads thus serves to convey the toner particles to the development zone. In a typical two-component contact developing system, the magnetic brush with toner particles thereon is brought into direct contact with the surface 12 of the belt 10, to develop the latent image thereon.

Other types of features for development of latent images, such as developer rolls, paddles, scavengeless-development electrodes, commutators, etc., are known in the art and could be used in conjunction with various embodiments pursuant to the claims. In the illustrated embodiment, there is further provided air manifolds 140, 142, attached to vacuum sources (not shown) for removing dirt and excess particles from near belt 10.

Figure 4:
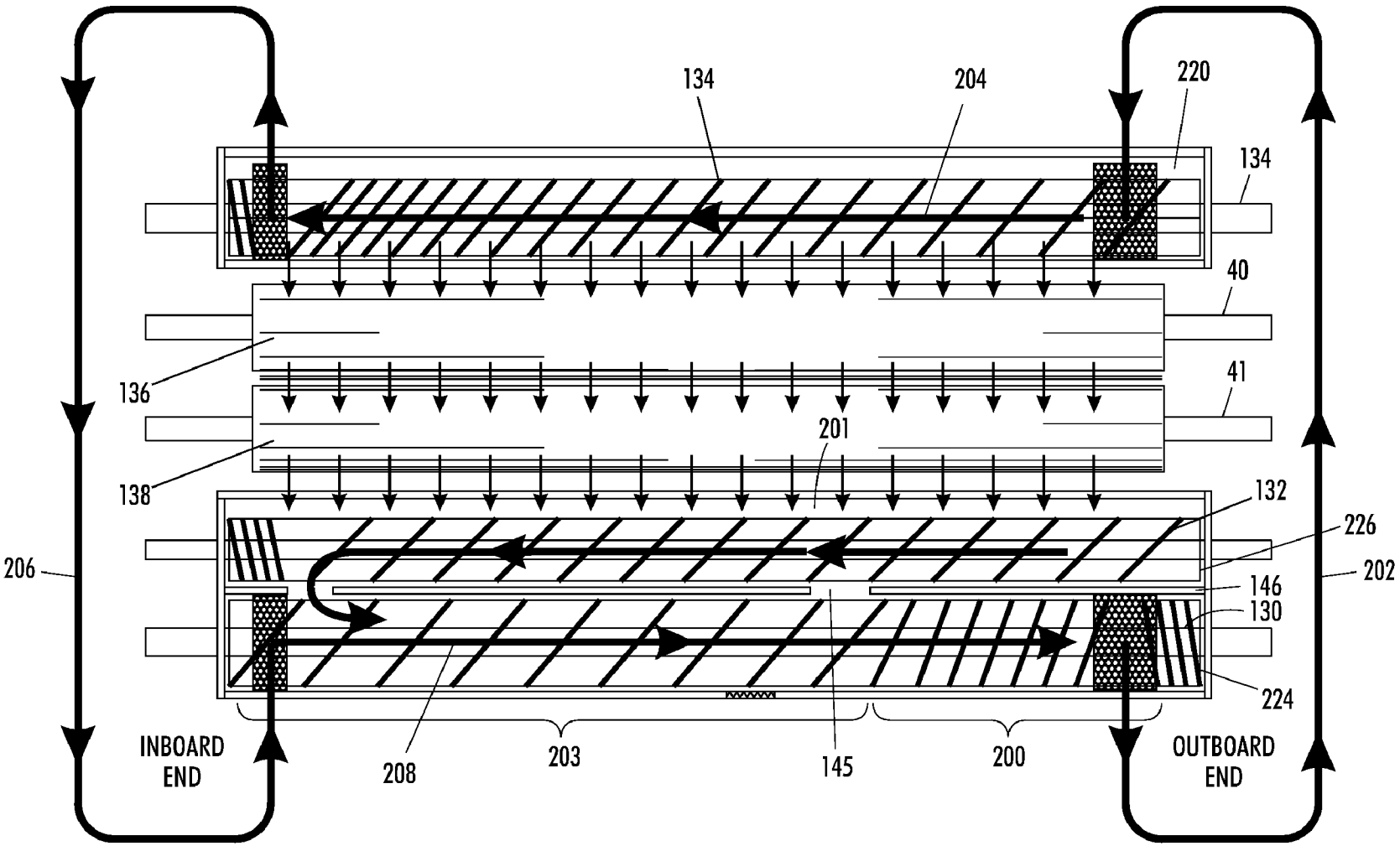
FIGS. 4 and 5 illustrate developer material flow patterns in developer unit used in FIG. 2.
Figure 5:
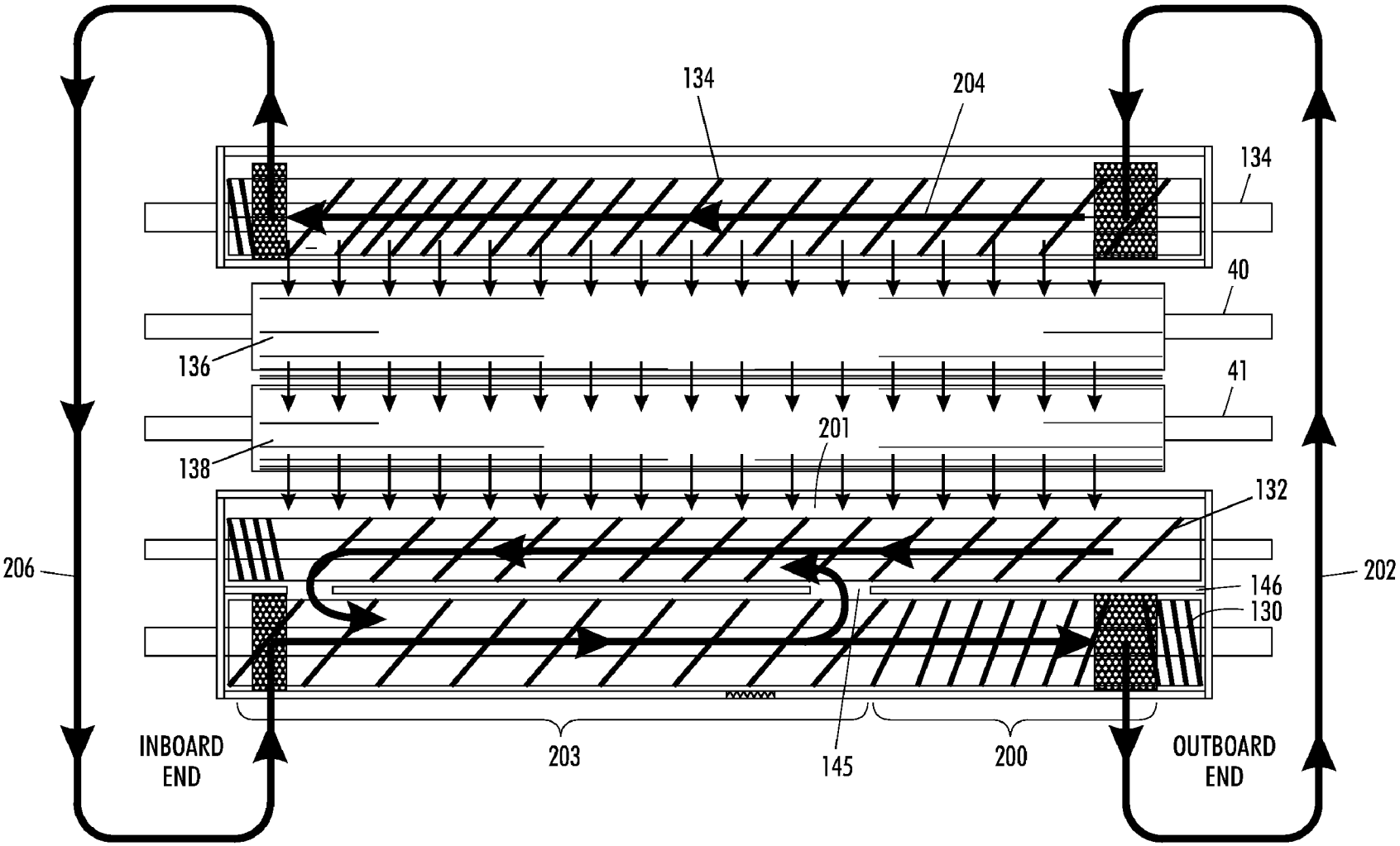
Figure 6:
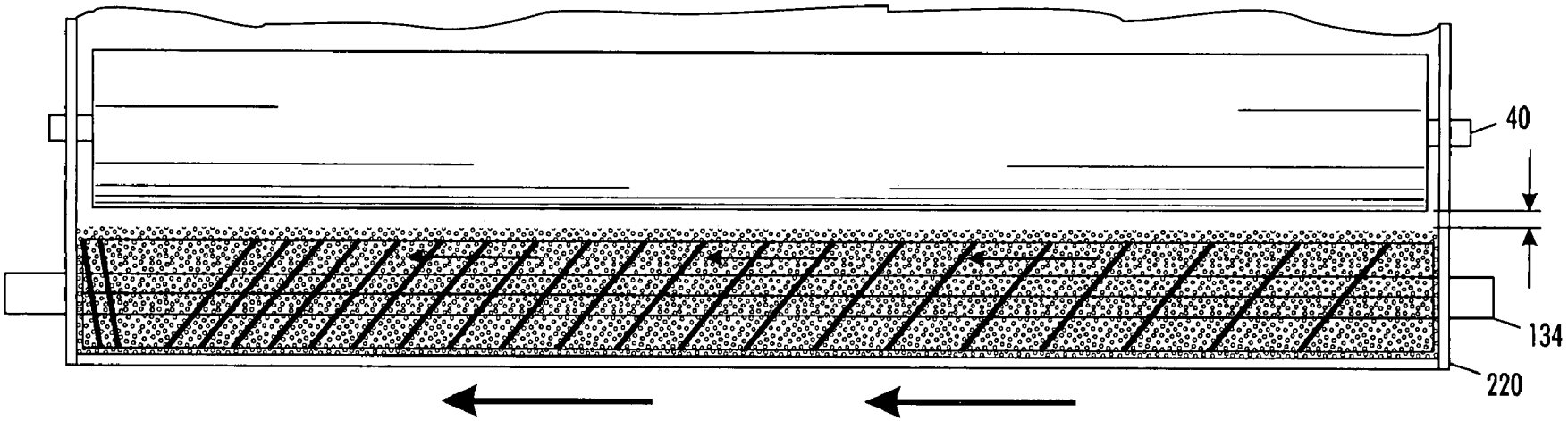
FIG. 6 is a side view illustrating the developer material flowing in an auger of the present disclosure.

FIGS. 4-6 are diagrams for the developer material flow pattern in the housing. The diagrams are topologically correct. The inboard to outboard placement of the features is relationally correct. The location of the "pick up", trim, handoff, and development functions are logically correct. For the actual placement of the various components/features, please refer to FIG. 2.

Auger 134 is an upper transport auger located in auger channel 220. Mixing/pump auger 130 and transport auger 132 are located below auger 134 and are disposed in auger channel 224 and auger channel 226. Auger 134 receives developer material from the pump section 200 of the mixing/pump auger 130 and developer material moves along portion 202 of the developer material flow pattern. The auger 134 then transports this material from outboard to inboard along the full length of the housing along portion 204 of the developer material flow pattern. The upper developer roll 40 "picks up" material from auger 134 for use in the development process. Any material that is not "picked up" and used to develop the image is ultimately dropped back down into the mixing/pump auger 130 (as illustrated by the downward arrows) at the inboard end of the developer housing along portion 206 of the developer material flow pattern.

Now focusing on the developer material, the developer material flows in the lower portion of the housing, spillway 145 is located at an opening near the top of the wall 146 separating the mixing/pump auger 130 from the lower front auger 132. It is located just before the junction between the mixing section 203 and pump section 200 of the mixing/pump auger 130. Spillway 145 is an opening defined in wall 146 and acts as a pressure relief vent; if more material is delivered to the pump section 200 of the mixing/pump auger 130 than the pump can utilize, the excess material spills over the wall 146 and into the lower front auger 132.

The mixing/pump auger 130 has several functions. It a) transports material from inboard to outboard along the developer material flow pattern 208, as shown in FIG. 4, b) mixes in the replenisher (replacement toner and carrier)

supply delivered at the inboard end, c) pumps developer material up to the upper transport auger 134, and d) acts as part of the material mass (volume) buffer to accommodate changes in developer sump charge mass (volume). Auger 130 has been designed with a larger pitch to diameter ratio (P/D) preferably by a factor of 2 in the mixing transport section 203 than in the pump section 200. This results in a larger transport rate in section 203 than in section 200. Transport rate is the physical displacement of material per unit time. It is expressed in units of mm/sec or units of mm/rev of the auger. Given equal cross sectional filling factors, section 203 will have a larger volumetric flow rate than section 200. Volumetric flow is the volume of developer material crossing AN imaginary plane per unit time. In an auger, this is equal to the "Transport rate" times the cross sectional area of the filled portion of the auger (channel).

Now focusing on the present disclosure, referring to FIG. 6, an "Upper Transport Auger" or "Pick Up Auger" with a variable pitch, it has been found that the optimum pitch variation is linear down the length of the auger 134. A variable pitch auger maintains a constant volumetric filling in auger channel 220. The significance of this is that the distance between the developer material in the auger channel 220 available for "pick up" and the developer roll is kept constant down the length of the roll and auger channel. This maintains the "pick up" material supply at a constant (and close) distance from the pickup region of the developer roll thereby eliminating the need to over achieve the "pick up" function at one end. This enables the use of lower strength "pick up" magnetic fields and at the same time presents a uniform amount of material to the trim region independent of position down the length of the roll. The lower strength pick up magnetics reduces the mechanical power required to drive the housing, enhances developer roll shell life, and reduces developer material abuse. The uniform amount of material presented to the trim region improves the MOR uniformity.

In operation, material (for use in development) is removed uniformly down the length of the upper transport auger by the upper developer roll 40 at the pickup region. This material is trimmed/metered to a desired layer thickness and utilized to develop an image. After development, the material is delivered to the lower auger, not back into the upper transport auger. Since, the developer material is not returned to the pickup upper transport auger, the auger's material transport requirement (to supply the developer material to the upper developer roll) decreases linearly down the length of the auger. Material transport for an auger is proportional to the pitch, filled cross sectional area, and rotational speed. Hence, the material transport rate may be decreased linearly and the filled cross sectional area may be held constant if the pitch of the auger is linearly decreased (at the appropriate rate).

Applicants have found that a Pitch to Diameter ratio of 0.7 on the outboard (up feed) end and about 0.4 on the inboard (down feed) end of the auger provides an approximately constant cross sectional filling area for nominal conditions. It should be noted that the pitch can be varied stepwise or varied continuously.

Figure 7:
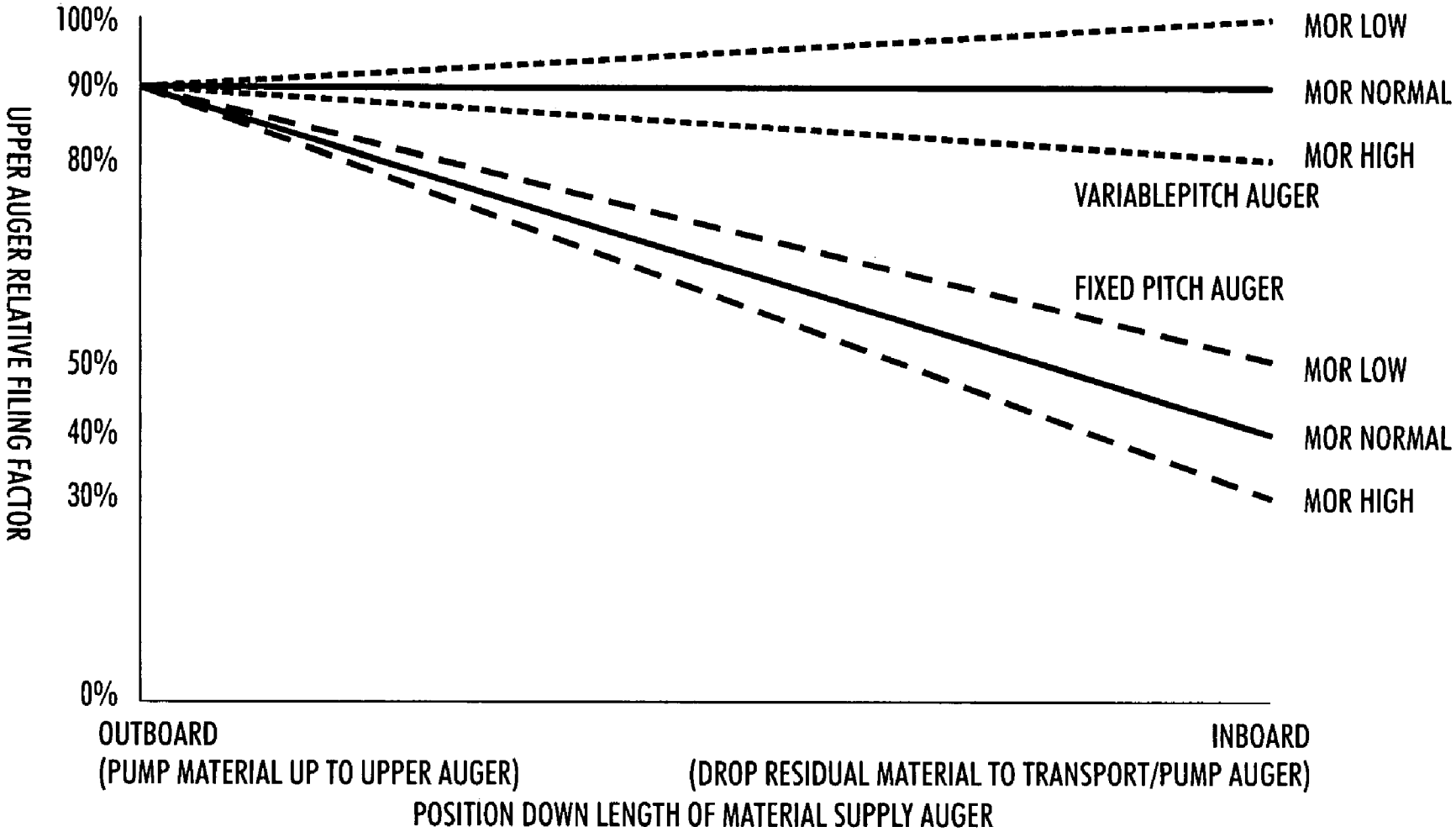
FIG. 7 is experimental data.

As illustrated in FIG. 7, nominal conditions are: developer mass on roll (MOR) of about 37 mg/cm$^2$, roll surface velocity of about 700 mm/sec, auger rotational speed of 800 RPM.

There are several benefits. Since, the upper transport auger's filled cross sectional area in the channel is approximately constant, there is less observed variation in MOR between the inboard and outboard (trimming is a slight function of the amount of material presented to the trim blade). Because the gap between the developer material surface and the developer roll surface is small and uniform, applicants have been able to reduce the strength of the pick up pole magnet. As a result, less material is in general picked up and delivered to the trim region. This reduces the amount of power required to drive the developer roll, reduces wear on both the developer roll surface and developer material itself, and significantly increases the nominal trim blade gap required to meter the desired 37 mg/cm$^2$ MOR.

Figure 8:
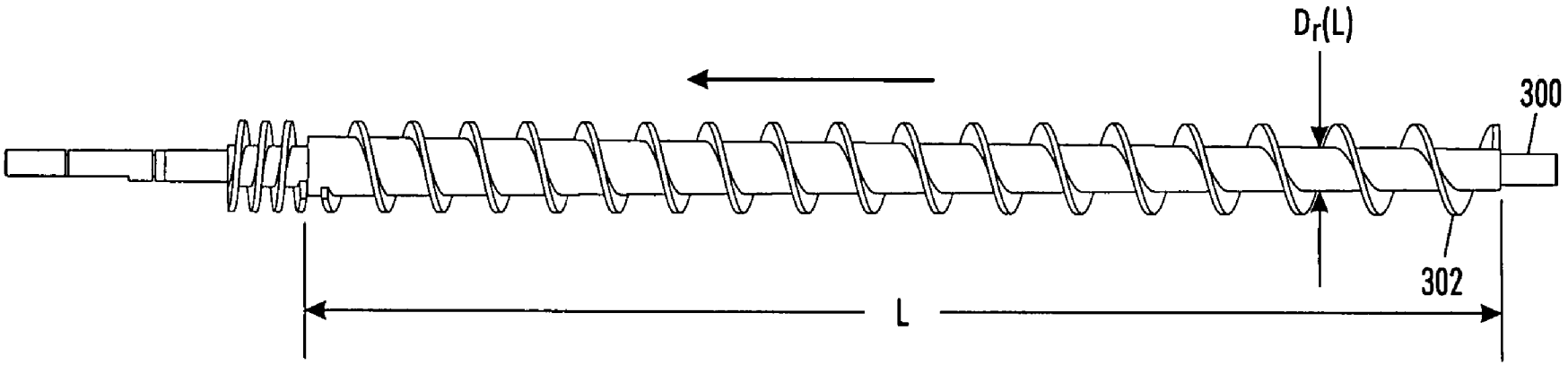
FIG. 8 is a side view illustrating the developer material flowing in another embodiment of an auger of the present disclosure.

Now referring to FIG. 8 which illustrates an alternative embodiment of the present disclosure for maintaining a uniform constant cross sectional filling factor within the pick up auger channel. As illustrated in FIG. 8, core 300 has a plurality of blades 302 positioned about core 300. The core size of the auger is varied to maintain a uniform constant cross sectional filling factor within the pick up auger channel. Preferably the core is round and the root diameter is varied in a fashion so as to compensate for the volume of developer material which has been picked up and used for development. In the case where the volume of developer material used for development is constant down the length of the developer roll, the root diameter. $D_R$, would need to increase and can be determined by the following equation:

$$D_R(L)=((D_0)^2+K\times L)^{1/2}.$$

where, L is the distance down the length of the magnetic brush, $D_0$ is the root diameter of the auger at the edge of the magnetic brush, and K is a function of auger pitch (P), auger rotational period (τ), developer roll surface velocity (V), developer material density (ρ), and developer roll mass per unit area on the roll (MOR).

K is given by: $K=4\times P\times V\times MOR\times\tau/(\pi\times\rho)$.

It should be noted that the two concepts of varying core size and varying Pitch to Diameter ratio can be combined to also produce an useful auger for maintaining a uniform constant cross sectional filling factor within the pick up auger channel It is, therefore, apparent that there has been provided in accordance with the present invention, an Auger that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A developer system, comprising:

a developer housing having a sump containing developer material including toner particles;

a developer member rotatably mounted in said housing for transferring toner particles to a latent image on said photoreceptive member in a development zone;

a pickup auger, positioned in an auger channel, for transporting and delivering developer material to said developer member, along a path adjacent to said developer member, said pickup auger having a first end portion and a second end portion, and said pickup auger includes a plurality of blades extending along the length of thereof, said plurality of blades being mounted on a core having a core size, said core size being adapted and arranged in said auger channel to maintain a constant developer material distance from said developer member along the length said auger channel, and wherein said core size has increases in core size from one end to another end.

2. A developer system, comprising:

a developer housing having a sump containing developer material including toner particles;

a developer member rotatably mounted in said housing for transferring toner particles to a latent image on said photoreceptive member in a development zone;

a pickup auger or positioned in an auger channel, for transporting and delivering developer material to said developer member, along a path adjacent to said developer member, said pickup auger having a first end portion and a second end portion, and said pickup auger includes a plurality of blades extending along the length of thereof, said plurality of blades being mounted on a core having a core size, said core size being adapted and arranged in said auger channel to maintain a constant developer material distance from said developer member along the length said auger channel, and wherein said core is substantial round having a root diameter which varies from one to another end of said auger.

3. A developer system of claim 1, wherein said blades have a constant pitch from said first end to said second end.

4. A developer system of claim 1, wherein said blades have a different pitch from said first end to said second end.

5. A developer system of claim 4, wherein said pickup auger having a first blade nearest said first end and a last blade nearest said second end, and said blades having a continuously decreasing blade pitch to diameter ratio from said first blade to said last blade.

6. A developer system of claim 1, wherein having a first end portion of said pickup auger picks up developer material, and said second end portion of said pickup auger returns developer material to said sump.

7. A developer system of claim 1, further comprising a transport system for transporting developer material from developer housing to said developer member.

8. A developer system of claim 7, wherein said transport system includes a mix/pump auger for mixing and circulating developer material within said sump and supplying developer material to said pick-up auger.

9. A developer system of claim 2, wherein said root diameter is defined by the following equation:

$$D_R(L)=((D_0)^2+K\times L)^{1/2}$$

where, L is the distance down the length of the developer member, $D_0$ is the root diameter of the auger at the edge of the developer member, and K is a function of auger pitch (P), auger rotational period (τ), developer member surface velocity (V), developer material density (ρ), and developer member mass per unit area on the roll (MOR). K is given by: $K=4\times P\times V\times MOR\times\tau/(\pi\times\rho)$.

10. A xerographic printer having a developer system, comprising:

a developer housing having a sump containing developer material including toner particles;

a developer member rotatably mounted in said housing for transferring toner particles to a latent image on said photoreceptive member in a development zone;

a pickup auger, positioned in an auger channel, for transporting and delivering developer material to said developer member, along a path adjacent to said developer member, said pickup auger having a first end portion and a second end portion, and said pickup auger includes a plurality of blades extending along the length of thereof, said plurality of blades being mounted on a core having a core size, said core size being adapted and arranged in said auger channel to maintain a constant developer material distance from said developer member along the length said auger channel, and wherein said core size has increases in core size from one end to another end.

11. A xerographic printer of claim 10, wherein said core is substantial round having a root diameter which varies from one end to another end of said auger.

12. A xerographic printer of claim 10, wherein said blades have a constant pitch from said first end to said second end.

13. A xerographic printer of claim 10, wherein said blades have a different pitch from said first end to said second end.

14. A xerographic printer of claim 13, wherein said pickup auger having a first blade nearest said first end and a last blade nearest said second end, and said blades having a continuously decreasing blade pitch to diameter ratio from said first blade to said last blade.

15. A xerographic printer of claim 10, wherein having a first end portion of said pickup auger picks up developer material, and said second end portion of said pickup auger returns developer material to said sump.

16. A xerographic printer of claim 10, further comprising a transport system for transporting developer material from developer housing to said developer member.

17. A xerographic printer of claim 16, wherein said transport system includes a mix/pump auger for mixing and circulating developer material within said sump and supplying developer material to said pick-up auger.

18. A xerographic printer of claim 11, wherein said root diameter is defined by the following equation:

$$D_R(L)=((D_0)^2+K\times L)^{1/2}$$

where, L is the distance down the length of the developer member, $D_0$ is the root diameter of the auger at the edge of the developer member, and K is a function of auger pitch (P), auger rotational period (τ), developer member surface velocity (V), developer material density (ρ), and developer member mass per unit area on the roll (MOR). K is given by: $K=4\times P\times V\times MOR\times\tau/(\pi\times\rho)$.

* * * * *